US007896153B2

(12) United States Patent
Shafik

(10) Patent No.: US 7,896,153 B2
(45) Date of Patent: Mar. 1, 2011

(54) TOILET UTENSIL KIT

(76) Inventor: Aasef Shafik, Annandale, VA (US)

( * ) Notice: Subject to any disclaimer, the term of this patent is extended or adjusted under 35 U.S.C. 154(b) by 181 days.

(21) Appl. No.: 11/823,538

(22) Filed: Jun. 28, 2007

(65) Prior Publication Data

US 2009/0000967 A1 Jan. 1, 2009

(51) Int. Cl.
*A45D 44/18* (2006.01)
*B65D 83/10* (2006.01)
*B65D 71/00* (2006.01)

(52) U.S. Cl. ..... 206/15.3; 206/361; 206/581

(58) Field of Classification Search ..... 211/65; 206/804, 457, 581, 361, 15.2, 15.3; 15/184, 15/257.01, 104.92, 160, 142; 134/42; 277/355; 248/118; 220/826
See application file for complete search history.

(56) References Cited

U.S. PATENT DOCUMENTS 2,031,374 A * 2/1936 Liedtke et al. ..... 15/142
2,464,085 A 3/1949 Hess
D161,014 S 11/1950 Gerson
2,539,838 A 1/1951 Hurley
3,429,474 A 2/1969 Cann
4,033,650 A 7/1977 Alissandratos
4,432,451 A 2/1984 Hooser
D272,874 S 3/1984 Cohen
4,625,882 A * 12/1986 Sullivan ..... 206/457
4,982,921 A * 1/1991 Sanders ..... 248/118
D356,893 S 4/1995 Conmy
5,456,356 A 10/1995 Kurzawa
5,836,322 A * 11/1998 Borger et al. ..... 134/42
5,958,150 A * 9/1999 Borger et al. ..... 206/15.3
5,971,141 A * 10/1999 Shafik ..... 206/361
6,010,132 A * 1/2000 Bagepalli et al. ..... 277/355
6,367,621 B1 * 4/2002 Johnson ..... 206/15.3
6,926,137 B2 * 8/2005 Rudnick et al. ..... 206/15.3
6,981,735 B1 * 1/2006 Stephens ..... 248/118

* cited by examiner

*Primary Examiner*—Ehud Gartenberg
*Assistant Examiner*—Kaushikkumar Desai
(74) *Attorney, Agent, or Firm*—Dennis H. Lambert

(57) ABSTRACT

A toilet utensil holder for holding toilet utensils such as a toilet brush and a plunger is shaped as a ship. The holder has a base section forming a hull of the ship, with basins for receiving the utensils, and in a preferred embodiment covers are pivoted to the base section for covering an operative end of the utensils and forming a superstructure of the ship. Handles of the utensils extend above the base portion, and in the preferred embodiment above the covers, and simulate masts or other parts of a ship. A handle may be affixed to the holder to lift and carry it.

3 Claims, 6 Drawing Sheets

TOILET UTENSIL KIT

TECHNICAL FIELD

This invention relates to bathroom accessories, and more particularly to an aesthetically pleasing toilet utensil holder and kit.

BACKGROUND ART

Residential and commercial toilets require frequent cleaning, and may also sometimes require clearance of a blockage which prevents proper drainage of water from the toilet. The most frequently used cleaning utensil is a brush or similar tool which is used to scrub the toilet bowl. If the drain from the toilet becomes blocked, a plunger is commonly used to alternately produce pressure and suction in the trap to dislodge the obstruction. In many instances one or more of these utensils is simply placed on the floor near the toilet, or in a cabinet under a sink, or in a nearby location. Placing utensils on the floor near the toilet or in a cabinet under a sink is both unsightly and unsanitary. Placing them in a nearby location may remove them from sight, and they can be stored in a sanitary manner, but they are not readily available when needed.

Several types of holders and/or covers have been developed in the art to hold toilet utensils near the toilet and readily available, but out of sight. Most of these comprise a holder or cover for supporting only a single utensil, such as a brush or a plunger. Others, such as those disclosed in applicant's prior U.S. Pat. Nos. 5,971,141 and D530,550 are designed to hold multiple utensils, such as a toilet brush and a plunger, and even extra rolls of toilet paper. The holder disclosed in U.S. Pat. No. 5,971,141 is designed to hold a toilet brush and plunger as well as extra rolls of toilet paper, and although it clearly has advantages over not using any holder at all, or using multiple holders that support only a single utensil, it has a very simple design intended primarily to cover and enclose the utensils. The holder disclosed in D530,550 has a more intricate, aesthetically pleasing design and also holds more than one utensil, but the utensils themselves remain at least partially exposed and visible.

Other prior patents disclosing various types of toilet utensil holders are U.S. Pat. Nos. 2,464,085, 2,539,838, 3,429,474, 4,033,650, 4,432,451 and 5,456,356, and U.S. design Pat. D161,014, D272,874 and D356,893. U.S. Pat. No. 5,456,356 describes a plunger accessory including a housing which encloses the plunger and has an elongate handle portion upon which extra rolls of toilet paper may be stored. Design Pat. D161,014 and D272,874, and U.S. Pat. Nos. 2,464,085, 2,539,838, 3,429,474 and 4,033,650 all disclose toilet brush holders of various styles and constructions. Design Pat. D356,893 and U.S. Pat. No. 4,432,451 both disclose devices for holding and storing toilet plungers. In addition, D356,893 discloses use of the device for holding a brush. None of the patents noted above discloses a toilet utensil holder with means for supporting and covering both a toilet brush and plunger, wherein the holder has a thematic shape, with the handles of the utensils forming a part of the holder design theme, and a cover or covers to hide the operative ends of the utensils from view, said cove or covers also forming part of the design theme. In prior art devices, the toilet brush and plunger are either stored separately in different holders, or are stored in the open and in plain sight, detracting from the decor of the bathroom, or the brush and plunger are stored in a remote location, detracting from the convenience of use.

Accordingly, there is need for a toilet utensil holder that holds and covers multiple, commonly used toilet utensils, such as a toilet brush and a plunger, with parts of the utensils forming part of the design of the holder, rendering the holder aesthetically pleasing so that it may be left in a bathroom without detracting from the decor thereof.

DISCLOSURE OF THE INVENTION

The present invention is a toilet utensil holder for at least one toilet utensil, and preferably a plurality of utensils such as a toilet cleaning brush and a plunger, adjacent a point of use, wherein parts of the utensils are incorporated as parts of the holder design.

The holder and kit comprise a one-piece molded base section, preferably shaped as the hull of a ship, in the embodiments disclosed herein, with a receptacle or basin in each end of the base section for holding a brush and a plunger, respectively. As used herein the term "ship" is intended to encompass a tug, boat, sailing vessel, and the like. In preferred embodiments one or more covers are pivoted to the base section in covering relation to the operative ends of the plunger and brush, and in the particular embodiments disclosed herein these covers preferably form a superstructure of a ship, boat, etc. The handles of the brush and plunger project above the covers and simulate masts or other structure extending above the superstructure. To remove the plunger and/or brush from the holder it is necessary only to grasp the handle and lift, causing the cover or covers to pivot upwardly out of the way. A lever arm can be connected to the covers to normally extend beneath the respective plunger or brush, whereby upon replacement of the plunger or brush in its respective basin the lever arm is pushed downwardly to close the cover.

In one form of the invention a separate pivoted cover is provided for each utensil, with the handle of the utensil extending through a slot in the free edge of the cover so that it is necessary only to grasp the handle and lift the utensil from its basin, which action also raises the cover to an upright, out-of-the way position. In a preferred embodiment a lever arm can be connected to the cover in a position to extend beneath the utensil when the utensil is in place in its basin. Upon return of the utensil to its basin, the utensil engages the arm to swing the cover closed. Thus, the user need not touch any part of the holder or utensil except the utensil handle.

In other forms of the invention a pair of pivoted covers are provided for each utensil, with the covers of each pair having their free edges lying adjacent one another at approximately a midpoint of the respective utensil basin, and their hinged edges lying outwardly of the respective basin.

Another form of the invention can include a fixed handle conveniently located to enable the user to lift the holder and kit as a unit for moving it to different locations.

In still other forms of the invention the holder can comprise only a base portion, with receptacles, for holding the utensils, and the superstructure, or parts of the superstructure, can be omitted.

The holder can be made of plastic or other suitable material, and the utensils can comprise conventional, commercially available utensils.

BRIEF DESCRIPTION OF THE DRAWINGS

The foregoing, as well as other objects and advantages of the invention, will become apparent from the following detailed description when considered in conjunction with the accompanying drawings, wherein like reference characters designate like parts throughout the several views, and wherein.

BEST MODES FOR CARRYING OUT THE INVENTION

Figure 1:
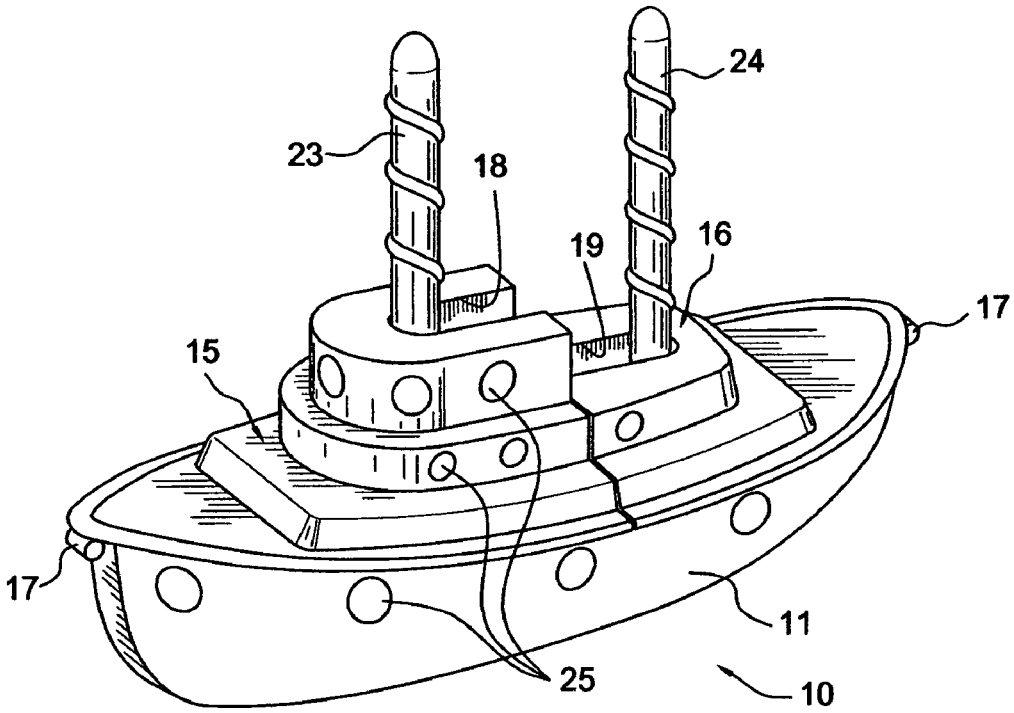
FIG. 1 is a top perspective view of a first embodiment of toilet utensil holder and kit according to the invention.

Referring more specifically to the drawings, a first form of toilet accessory kit according to the invention is indicated generally at 10 in FIGS. 1-4. The kit includes a base member 11 having the shape of the hull of a ship in the particular example described. The base member is hollow and defines utensil basins 12 and 13 in opposite ends. If desired, a dividing wall 14 (shown in broken lines in FIGS. 3 and 4) may be provided between the basins.

Covers 15 and 16 are pivoted by hinge members 17 at one end to opposite ends, respectively, of the hull. In a preferred embodiment the covers simulate the superstructure of a ship, boat, or the like, and extend from their respective pivoted edges to approximately the midportion of the base member, in covering relation to the basins 12 and 13. The covers have free inner end edges disposed in closely adjacent opposed relationship to one another when they are in their closed positions, and slots 18 and 19 are formed in the inner end edges of the respective covers, extending from approximately the center of each cover through its respective free edge. The slots may be left open or they may be closed with suitable means such as opposed rows of bristles 20*a* and 20*b* as shown in the left side of FIG. 2, or a split rubber cover 21 as shown in the right side of FIG. 2.

Figure 2:
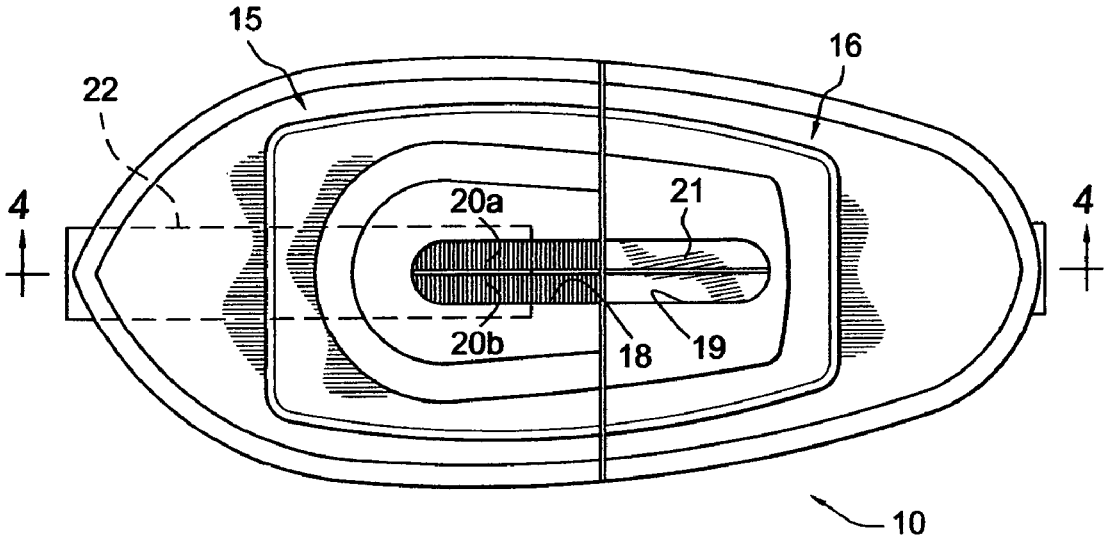
FIG. 2 is a top plan view of the kit of FIG. 1.

A lever arm 22 may be connected at one end thereof to each cover near its pivoted end and extended at its other end in spaced relation below the associated cover, as seen in broken lines in FIGS. 2 and 3 and full lines in FIG. 4. Thus, when the respective cover is raised to its open position, the lever arm is raised. When it is desired to return the utensil to its stored position in the holder, the utensil engages the lever arm and pushes it down, causing the associated cover to close. The lever arm may be made of a flexible material so that it has limited resilient movement to avoid interference with opening or closing movement of the associated cover. Only one lever arm is shown in the drawings but it should be understood that a lever arm could be associated with each cover, or the lever arms could be omitted entirely.

Figure 3:
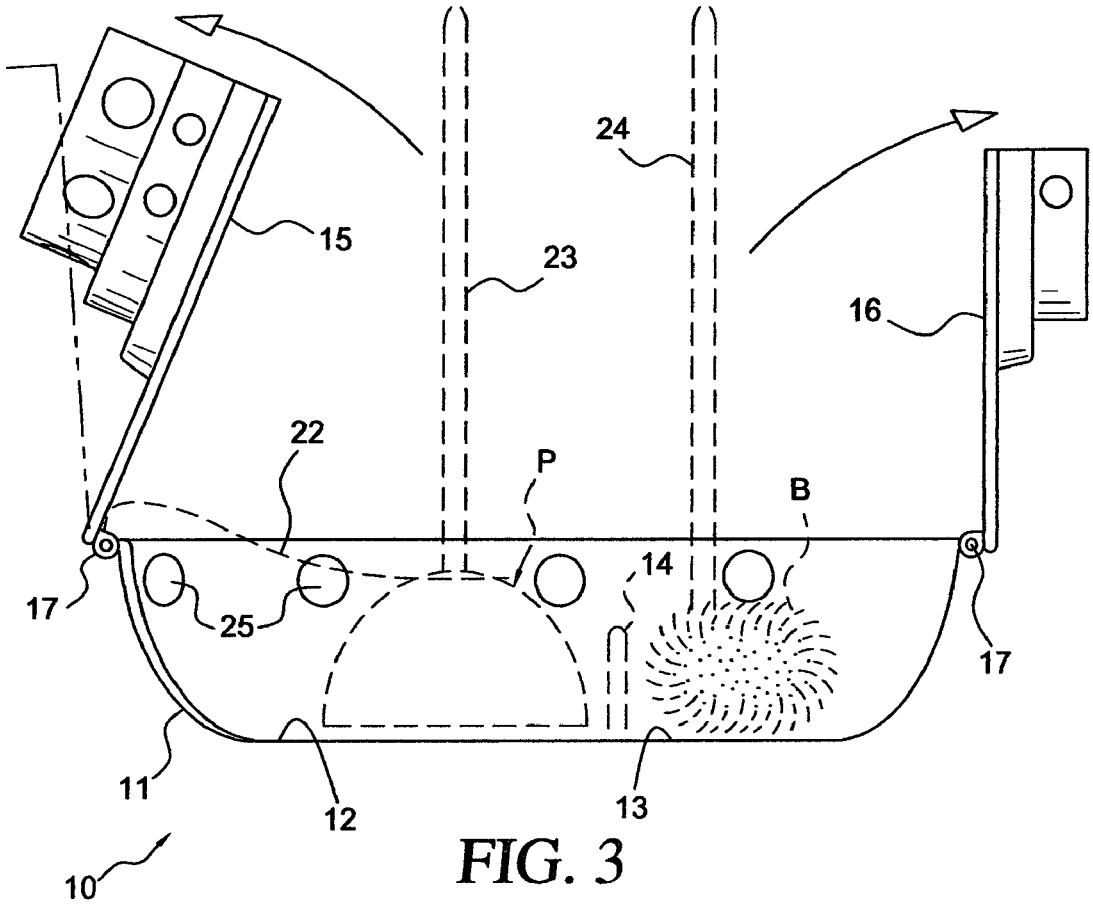
FIG. 3 is a side view in elevation of the holder of FIG. 1, with the utensils shown in broken lines and with the covers for the respective utensils shown in their opened positions.
Figure 4:
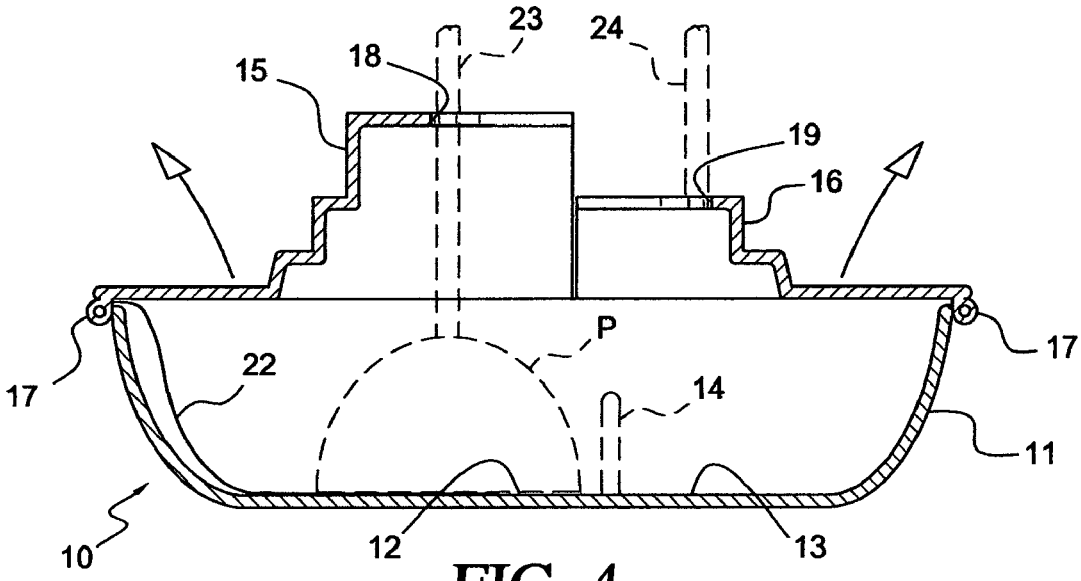
FIG. 4 is a longitudinal sectional view of the holder of FIG. 1, taken along line 4-4 in FIG. 2, with some parts shown in broken lines.

First and second utensils, such as a plunger P and a brush B, indicated by broken lines in FIG. 3, are received in the basins 12 and 13, respectively, with their handles 23 and 24 projecting upwardly through the respective slots 18 and 19 in the covers. In a preferred embodiment the handles simulate parts of the holder, such as masts of the ship in the particular examples described and illustrated herein. When it is desired to use one or more of the utensils, the user need only grasp the handle and lift, which will cause the cover to pivot open, with the handle exiting through the open end of the slot. When the utensil is returned to the basin, it will contact the lever arm and pivot the associated cover closed.

Decorative items 25 such as port holes, lifesavers, or the like, can be provided on the sides of the base member and/or superstructure.

Figure 5:
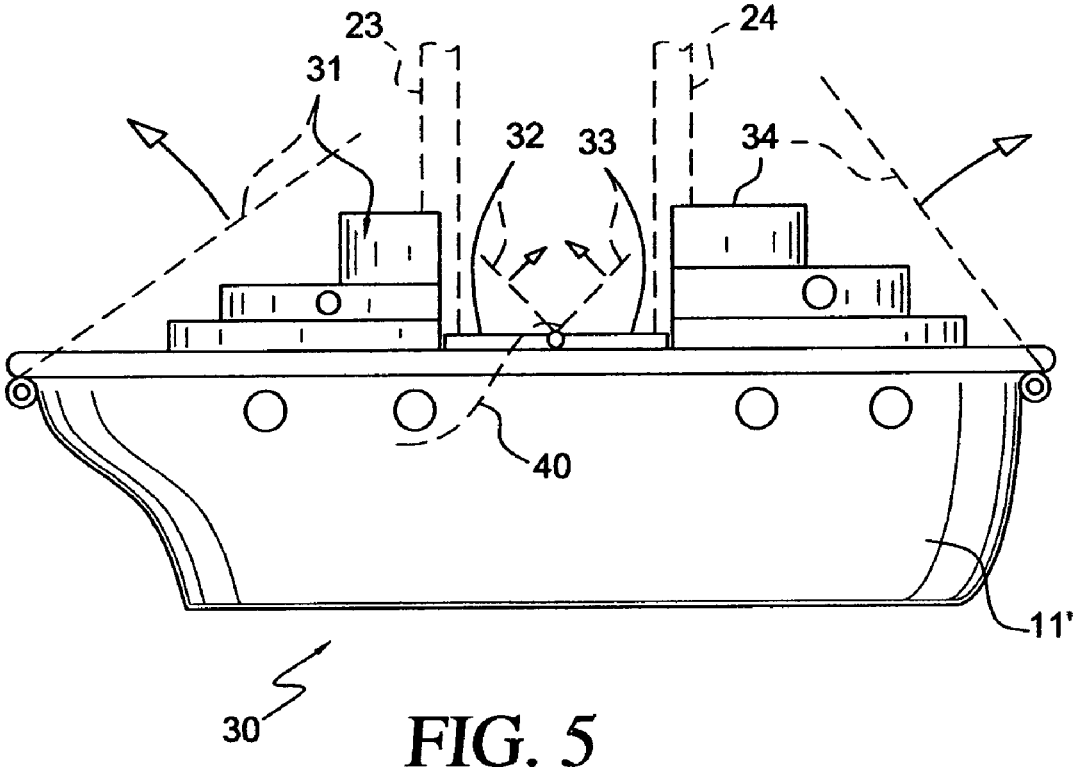
FIG. 5 is a side view in elevation of a second embodiment of the invention, wherein two oppositely pivoted covers are provided for each utensil, and showing the covers partially pivoted open in broken lines.
Figure 6:
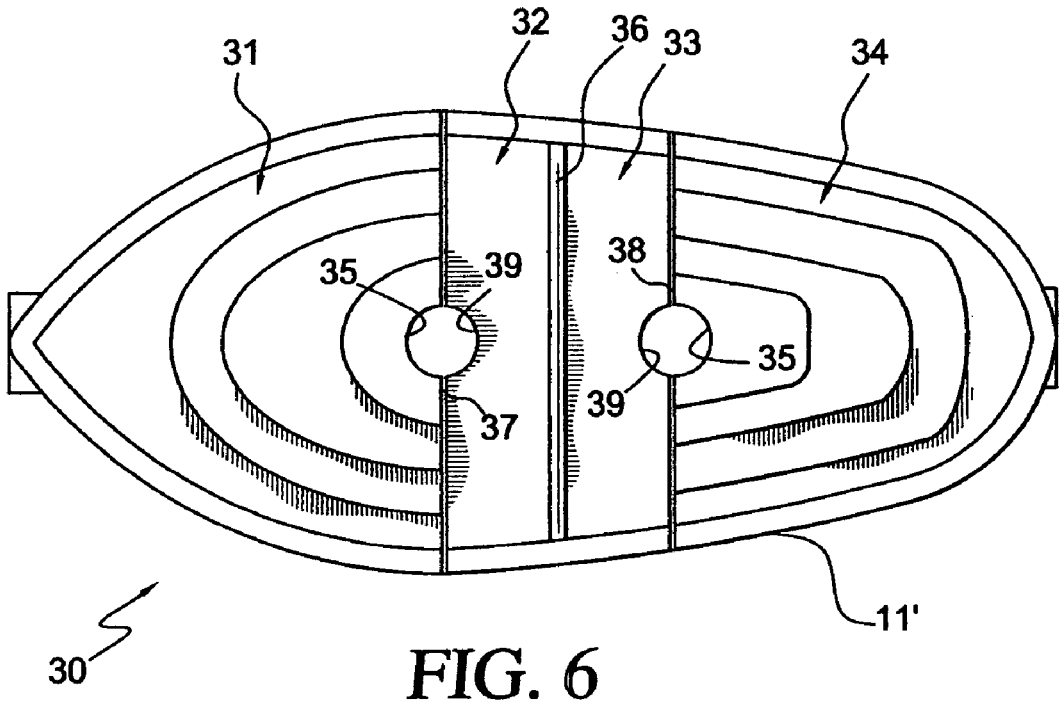
FIG. 6 is a top plan view of the plunger of FIG. 5.

A second embodiment of the invention is indicated generally at 30 in FIGS. 5 and 6. This form of the invention shows a different ship design than that shown in FIGS. 1-4. In this regard it should be understood that the invention is not limited to any particular ship design, but the design of any ship, boat, tug, sailing vessel, and the like could be employed. The shape of the hull 11' in this form of the invention differs from the previous form, as seen in the drawings, but this form differs from the previous forms primarily in that two covers 31 and 32 are associated with one utensil P, and two covers 33 and 34 are associated with the other utensil B. The covers 31 and 34 essentially comprise shortened versions of the covers 15 and 16 in the previous embodiment, with only a semi-circular notch 35 in their free edge to accommodate one-half of the diameter of the handle of the associated utensil. The covers 32 and 33 are pivoted to a common hinge 36 at adjacent edges, with their free edges 37 and 38 extending to adjacent the free edges of the covers 31 and 34. Semi-circular notches 39 are provided in the free edges of the covers 32 and 33, in alignment with the notches 35, for accommodating the other half of the diameter of the associated utensil handle. The use of two covers associated with each utensil can facilitate opening of the covers when the utensil is withdrawn from the holder, and can provide more clearance room during withdrawal and insertion of the utensils. If desired, the covers 32 and 33 can be biased toward an open position so that they remain raised to an out-of-the-way upright position when the associated utensil has been removed from the holder, to thereby enable the utensil to be returned to the holder without requiring the user to first lift that cover, but which include a lever arm 40 as in the previous embodiment to cause the cover to close when the utensil is returned to the holder. The lever arm 40 is indicated by broken lines in FIG. 5. In all other respects this form of the invention is essentially the same as the previous embodiment.

Figure 7:
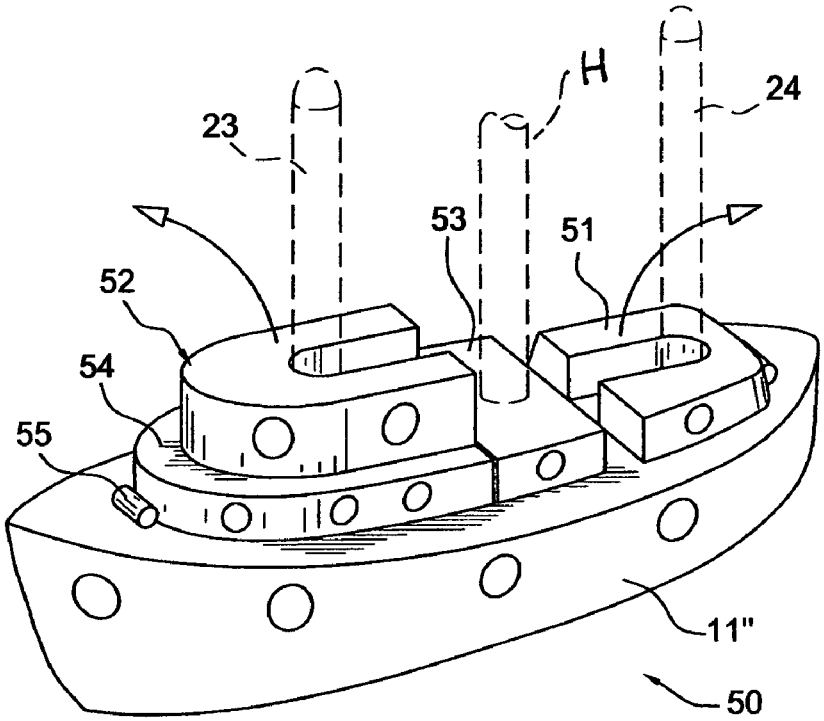
FIGS. 7 and 8 are top perspective views of further embodiments of the invention, wherein a fixed handle can be provided on the holder to facilitate carrying it, and wherein one of the utensil holding basins and its associated cover are smaller than the other utensil holding basin and its associated cover.
Figure 8:
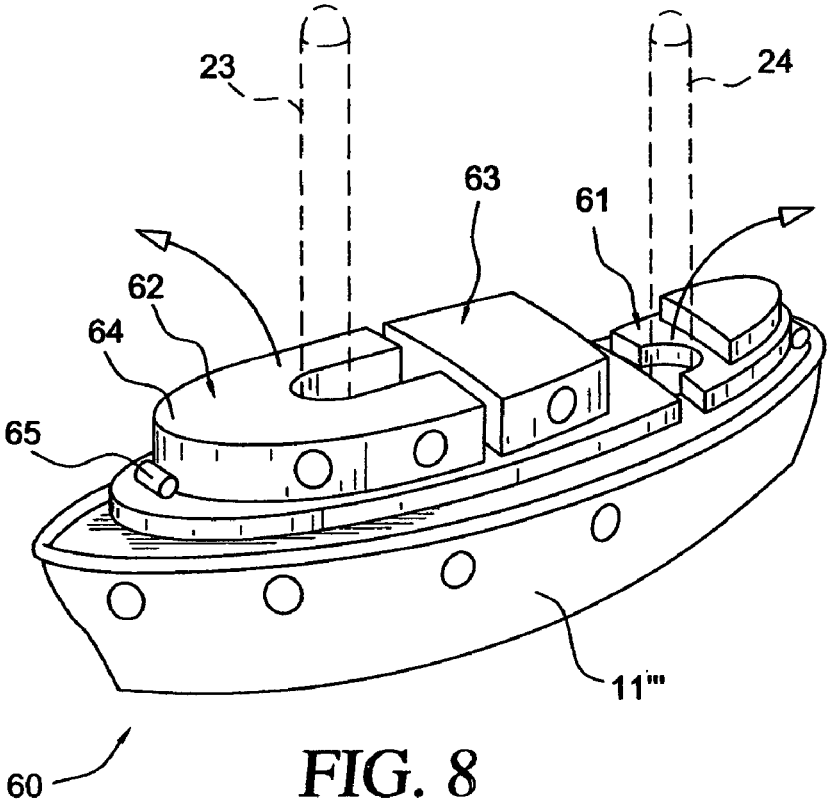

Third and fourth embodiments of the invention are indicated generally at 50 and 60 in FIGS. 7 and 8, respectively, and have different hull designs 11" and 11'", respectively. These forms of the invention function essentially the same as in the previous embodiments, except that the basin and associated cover 51 or 61, respectively, associated with the brush utensil B is smaller than the basin and cover 52 or 62, respectively, associated with the plunger utensil P. Further, the covers 51, 52 and 61, 62, respectively, are spaced from one another at their free edges and a fixed portion 53, 63, respectively, is positioned between the respective free edges. As shown in FIG. 7, a handle H may be attached to this fixed portion to enable the holder and associated utensils to be picked up and carried. Further, only parts 54 or 64, respectively, of the superstructures are pivoted by a hinge 55 or 65, respectively, rather than the entire deck and superstructure as in the previous embodiments.

Figure 9:
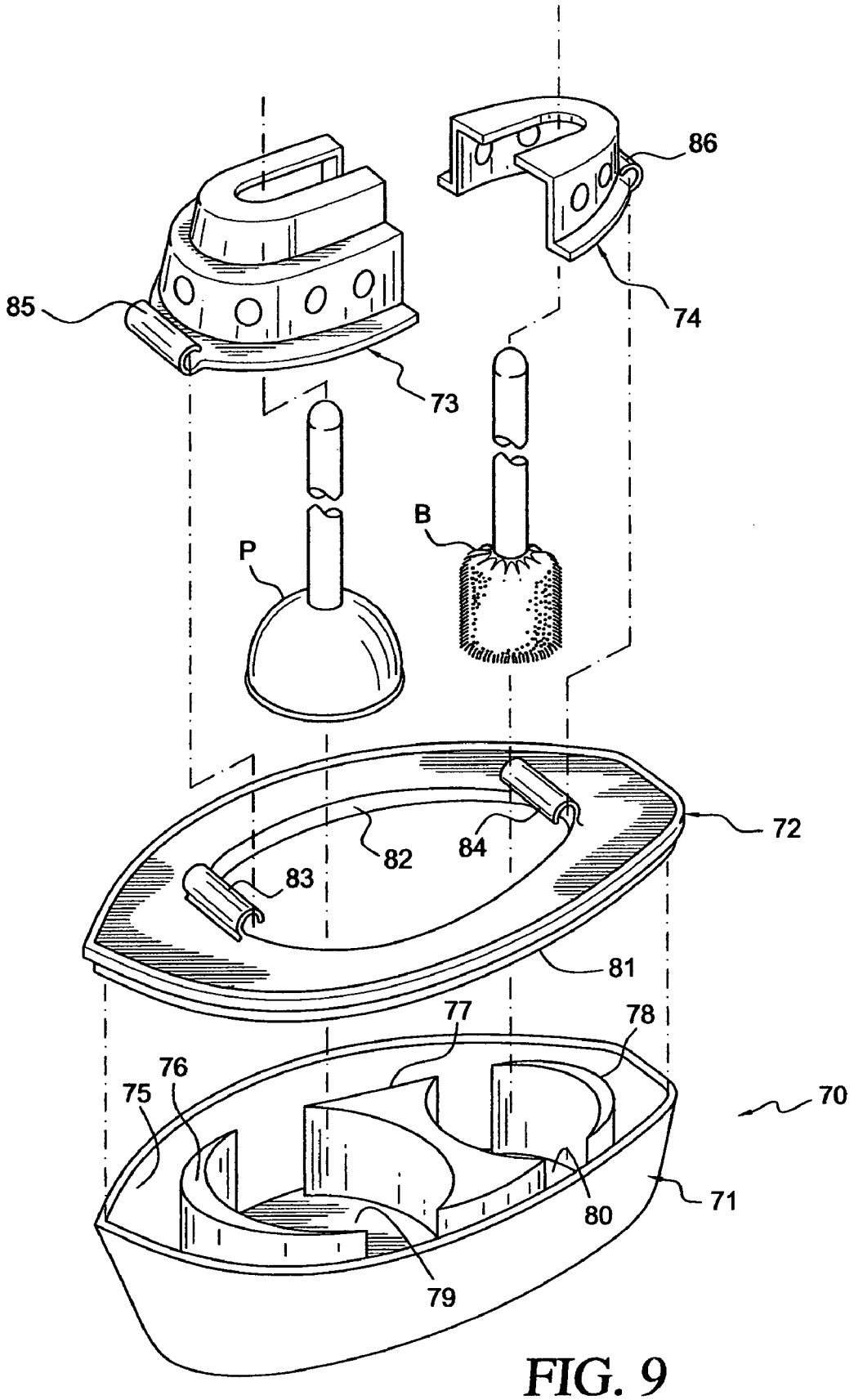
FIG. 9 is an exploded top perspective view of a still further form of the invention.

Referring to FIG. 9, a fifth embodiment is indicated generally at 70. In this embodiment there are four major components of the holder, comprising a base portion 71, first cover 72, and second and third covers 73 and 74. The base portion 71 has an open top 75 and dividers 76, 77 and 78 dividing the interior into two generally circular basins 79 and 80 for receiving a plunger P and brush B, respectively. The first cover 72 is substantially flat, with a narrow depending flange 81 adapted to fit snugly or snap into the marginal upper edge of the base portion. The cover 72 also has a large central opening 82 that generally follows the contour of the base portion and extends at its margins at least to the outer diameter of the basins 79 and 80, and hinge structures 83 and 84 at opposite ends of the opening 82. The second and third covers 73 and 74 are shaped similarly to the covers 15 and 16 in the FIG. 1 embodiment, but are formed separately from the first cover portion or "deck" 72, and have hinge structures 85 and 86 on their outer ends adapted to cooperate with the hinge structures 83 and 84 on the first cover, whereby the covers 73 and 74 are pivotally mounted to the first cover 72. The purpose and function of this embodiment are otherwise generally the same as in the previous embodiments.

Figure 10:
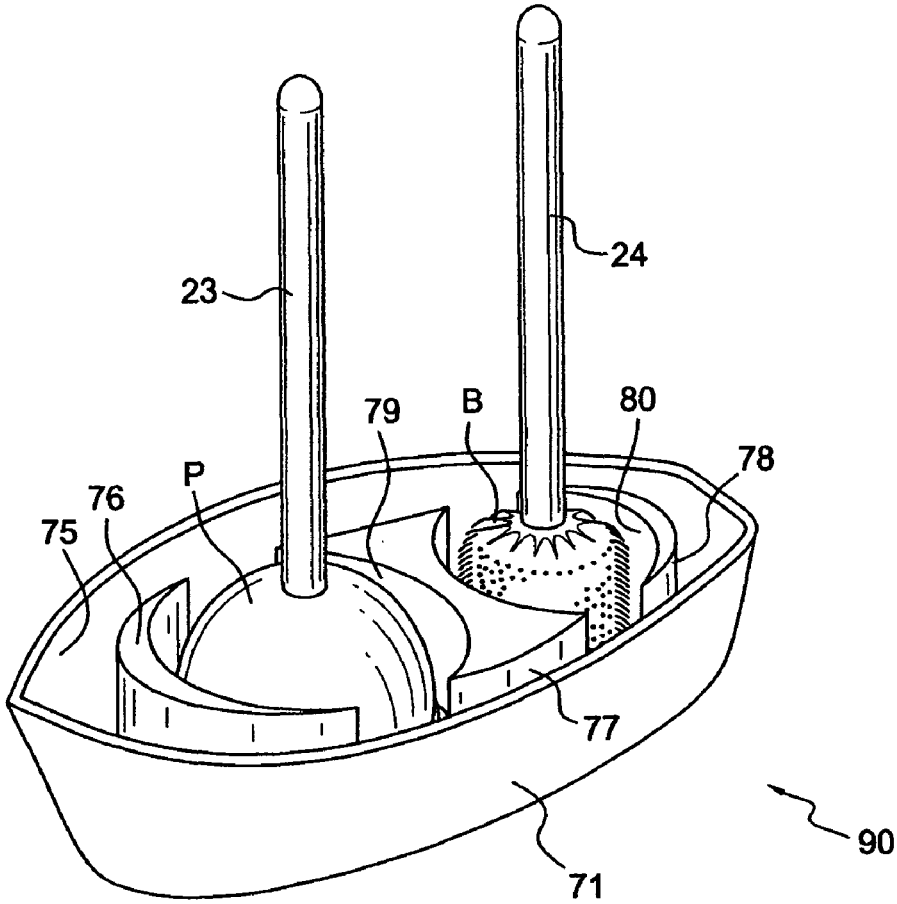
FIG. 10 is a top perspective view of yet another form of the invention wherein the holder comprises only a base portion.
Figure 11:
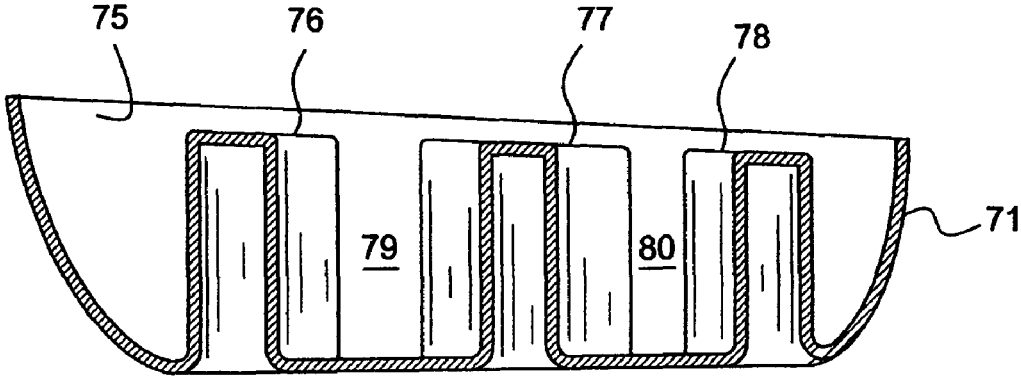
FIG. 11 is a longitudinal sectional view of the base portion of FIGS. 9 and 10.

FIG. 10 shows a sixth embodiment generally at 90. This embodiment comprises the base portion 71 of FIG. 9, and omits the first, second and third covers. Although not specifically illustrated, a seventh embodiment could comprise the base portion 71 and cover 72, but omit covers 73 and 74.

While particular embodiments of the invention have been illustrated and described in detail herein, it should be understood that various changes and modifications may be made to the invention without departing from the spirit and intent of the invention as defined by the scope of the appended claims.

What is claimed is:

1. In combination, a pair of toilet utensils each having an elongate handle, and a toilet utensil holder holding and covering said toilet utensils adjacent a point of use, wherein said holder comprises:

an elongate base section having length, width and height dimensions, said length dimension being greater than the width and height dimensions;

two basins in the base section, said basins being disposed in side-by-side relationship along the length of said base section, and one of said pair of toilet utensils being supported in one of said two basins and the other of said pair of toilet utensils being supported in the other of said two basins;

a first toilet utensil cover pivotally attached at one end thereof to said base section adjacent one end of the base section, and a second toilet utensil cover pivotally attached at one end thereof to said base section adjacent an opposite end of the base section, said toilet utensil covers being constructed to cover each respective said basin and a toilet utensil held therein when the respective covers are in their closed positions, said toilet utensil covers having inner end edges and being independently pivotable between a closed position in covering relation to a respective said basin to cover and obscure an operative end of a said toilet utensil held in that basin, and an upwardly pivoted open position permitting removal of a said toilet utensil from the basin covered by that cover;

an elongate slot formed in each said cover, extending from a midportion thereof through the inner end edge thereof;

the handles of said toilet utensils projecting upwardly through a respective said opening at said midportion of a respective cover when the cover is in a closed position and extending above said covers, wherein said covers are individually and independently pivotable upwardly out of the way to permit removal from the base section of one toilet utensil independently of the other utensil when the handle of said one utensil is grasped and lilted to lift the utensil against the cover and lift that cover to remove that utensil from the base section; and a lever arm connected to each said cover to extend beneath an associated said toilet utensil when the utensil is in a said basin, whereby upon replacement of that toilet utensil in said basin the lever arm is pushed downwardly to close said cover.

2. A toilet utensil holder as claimed in claim 1, wherein:

rows of opposed bristles extend along opposite side edges of said slots to close the slots.

3. A toilet utensil holder as claimed in claim 1, wherein:

a split rubber membrane closes said slots.

* * * * *